US011710461B2

(12) United States Patent
Park et al.

(10) Patent No.: US 11,710,461 B2
(45) Date of Patent: Jul. 25, 2023

(54) DISPLAY DEVICE AND METHOD FOR MEASURING GAMMA OF THE SAME

(71) Applicant: Samsung Display Co., LTD., Yongin-si (KR)

(72) Inventors: Geon Hwi Park, Anyang-si (KR); Jung Eon An, Asan-si (KR); Ki Hyun Pyun, Gwangmyeong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/545,992

(22) Filed: Dec. 8, 2021

(65) Prior Publication Data

US 2022/0301508 A1 Sep. 22, 2022

(30) Foreign Application Priority Data

Mar. 19, 2021 (KR) ..... 10-2021-0035945

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2320/0276* (2013.01); *G09G 2320/0673* (2013.01)

(58) Field of Classification Search
CPC ..... G09G 3/3266; G09G 3/3291; G09G 2320/0276; G09G 2320/0673
See application file for complete search history.

(56) References Cited

U.S. PATENT DOCUMENTS

2003/0001810 A1* 1/2003 Yamaguchi ..... G09G 3/3648 345/87
2005/0052350 A1* 3/2005 Mizukoshi ..... G09G 3/3233 345/55
2012/0242710 A1* 9/2012 Kang ..... G09G 3/3208 345/77
2013/0135272 A1* 5/2013 Park ..... G09G 3/006 345/211
2014/0354698 A1* 12/2014 Lee ..... G09G 3/3258 345/690
2016/0140894 A1* 5/2016 Eun ..... G09G 3/30 345/212
2016/0155382 A1* 6/2016 Cheon ..... G09G 3/3258 345/76
2016/0180771 A1* 6/2016 Jeong ..... G09G 3/3258 345/82
2016/0180815 A1* 6/2016 Pyo ..... G09G 3/3225 345/82
2016/0293101 A1* 10/2016 Jeong ..... G09G 3/2007

FOREIGN PATENT DOCUMENTS

KR 100495979 B1 6/2005
KR 1020120108445 A 10/2012
KR 101272367 B1 6/2013
KR 101625816 B1 6/2016
KR 101943419 B1 1/2019
KR 102061554 B1 1/2020

* cited by examiner

*Primary Examiner* — Kenneth Bukowski
(74) *Attorney, Agent, or Firm* — Cantor Colburn LLP

(57) ABSTRACT

A gamma measurement method of a display device includes: storing a current value that is measured during gamma tuning of a display panel; resetting a target current of global current management (GCM) by referring to the current value; and measuring gamma of the display panel while applying the target current of the GCM.

10 Claims, 9 Drawing Sheets

| #45 (Efficiency Best Block) | | | | #31 | | | |
|---|---|---|---|---|---|---|---|
|  | | | |  | | | |
| Efficiency [cd/A] | Current weight | Current [A] | Luminance [nit] | Efficiency [cd/A] | Current weight | Current [A] | Luminance [nit] |
| 10 | 1.00 | 100 | 1000 | 8 | 1.25 | 1.25A | 1000 |

| | Gamma tuning [1%] | | Gamma measurement [4%] | | |
|---|---|---|---|---|---|
| Gray | Load ratio[%] | Current[A] | Current weight | Load ratio[%] | Current[A] |
| 0 | 1 | 0 | 1.1 | 4 | 0 |
| 64 | 1 | 0.25 | 1.1 | 4 | 1.1 |
| 128 | 1 | 0.6 | 1.1 | 4 | 2.64 |
| 192 | 1 | 0.85 | 1.1 | 4 | 3.74 |
| 255 | 1 | 1 | 1.1 | 4 | 4.4 |

DISPLAY DEVICE AND METHOD FOR MEASURING GAMMA OF THE SAME

This application claims priority to Korean Patent Application No. 10-2021-0035945, filed on Mar. 19, 2021, and all the benefits accruing therefrom under 35 U.S.C. § 119, the content of which in its entirety is herein incorporated by reference.

BACKGROUND

(a) Technical Field

This disclosure relates to a display device and a gamma measurement method thereof, and more specifically, to a gamma measurement method capable of preventing gamma shift during gamma measurement of a display device.

(b) Description of the Related Art

A display device may determine luminance with respect to a gray through gamma setting. For example, the display device may generate image data corresponding to a predetermined gray by using a gamma data set for a predetermined gray, and may display an image with predetermined luminance by applying a data voltage corresponding to the image data to a pixel.

The display device may display an image with luminance that is different from target luminance due to variations in a manufacturing process of the display device or a characteristic change according to use. It is desirable to correct the luminance of the display device to match the target luminance, and a gamma measurement procedure may be performed to confirm whether the corrected luminance matches a set gamma value.

SUMMARY

Gamma correction may be performed to adjust image data for a gray to match a predetermined gamma after the display device is manufactured. A luminance adjustment technique may be applied to the display device during driving. An initially set gamma may be shifted in an image that is displayed by applying the luminance adjustment technique.

Embodiments provide a gamma measurement method capable of preventing an initially set gamma from being shifted during gamma measurement after a luminance adjustment technique is applied to a display device.

A gamma measurement method of a display device according to an embodiment includes: storing a current value that is measured during gamma tuning of a display panel; resetting a target current of global current management ("GCM") by referring to the current value; and measuring gamma of the display panel while applying the target current of the GCM.

The current value may be a value of a current according to a load ratio of a first region that is a measurement region during the gamma tuning.

The gamma measurement method may further include selecting a gamma measurement condition of the display panel before the resetting of the target current.

The gamma measurement condition may include a second region that is a measurement region before the resetting of the target current. The resetting of the target current may include calculating the target current based on a load ratio related to the current value and a load ratio of the second region.

The target current may be a value obtained by multiplying the current value by a ratio of a load ratio size of the second region to a load ratio size of the first region.

The load ratio of the first region and the load ratio of the second region may be different from each other.

The display panel may be divided into a plurality of blocks. The target current may be reset in consideration of efficiency of a block of the plurality of blocks to which the first region belongs and efficiency of a block of the plurality of blocks to which the second region belongs.

The consideration of the efficiency of the block may be to assign current weights such that a block with highest efficiency among the plurality of blocks and another block among the plurality of blocks display same luminance.

The consideration of the efficiency of the block may be to set a weight of the block with the highest efficiency among the plurality of blocks to 1, and to set another block among the plurality of blocks to a value obtained by dividing the highest efficiency by the efficiency of the another block.

When the second region belongs to the polarity of blocks, a weight may be calculated in consideration of a ratio of the second region belonging to each of the plurality of blocks and the efficiency of each block.

A display device according to an embodiment includes: a display panel including pixels; a data driver which supplies a data voltage to the display panel; and a signal controller which supplies a data control signal and image data to the data driver. The signal controller includes: a storage which stores a current value that is measured during gamma tuning of the display panel; a sensing unit which senses driving currents of the pixels; and a calculator which calculates the current value by summing the driving currents sensed by the sensing unit, and resets a target current of global current management (GCM) by referring to the current value.

The signal controller may further include a gamma measurement selector which selects a gamma measurement condition and activates the calculator to reset the target current.

The current value may be a value of a current according to a load ratio of a first region that is a measurement region during the gamma tuning. The gamma measurement condition includes a second region that is a measurement region before resetting the target current. The calculator may calculate the target current based on a load ratio related to the current value and a load ratio of the second region.

The display device may further include a net power control (NPC) unit which calculates load ratios of measurement regions from an input image signal and supplying the load ratio of measurement regions to the calculator. The calculator may calculate the target current by comparing a size of the load ratio of the measurement region.

The NPC unit may calculate efficiency for each block of the display panel. The calculator may calculate the target current in consideration of the efficiency for each block.

The display panel may include a plurality of blocks. The calculator may calculate the target current by assigning current weights such that a block having highest efficiency and another block from among the plurality of blocks display same luminance.

The calculator may calculate the target current by setting a weight of the block with the highest efficiency to 1, and a weight of the another block to a value obtained by dividing h the highest efficiency by the efficiency of the another block.

The NPC unit may calculate a load ratio depending on the efficiency of each block of the display panel based on the load ratio for each block and the efficiency for each block.

The calculator calculates the target current in consideration of the load ratio depending on the efficiency for each block.

The display device may further include a GCM controller which receives the target current from the calculator and controls the GCM.

The GCM controller may compare a sensed current received from the sensing unit with the target current, and controls the GCM such that the sensed current matches the target current.

According to the embodiments, it is possible to prevent an initially set gamma from being shifted or distorted during gamma measurement after a luminance adjustment technique is applied to a display device. According the embodiments, there are other advantageous effects that can be recognized throughout the specification.

DETAILED DESCRIPTION

The inventive concept will be described more fully hereinafter with reference to the accompanying drawings, in which embodiments of the inventive concept are shown.

Further, sizes and thicknesses of constituent elements shown in the accompanying drawings are arbitrarily given for better understanding and ease of description.

It will be understood that when an element such as a layer, film, area, or substrate is referred to as being "on" another element, it can be directly on the other element or intervening elements may also be present. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items.

In addition, unless explicitly described to the contrary, the word "comprise" and variations such as "comprises" or "comprising" will be understood to imply the inclusion of stated elements but not the exclusion of any other elements.

In addition, in the specification, "connected" means that two or more components are not only directly connected, but two or more components may be connected indirectly through other components, physically connected as well as being electrically connected, or it may be referred to by different names depending on the location or function, but may include connecting each of parts that are substantially integral to each other.

Figure 1:
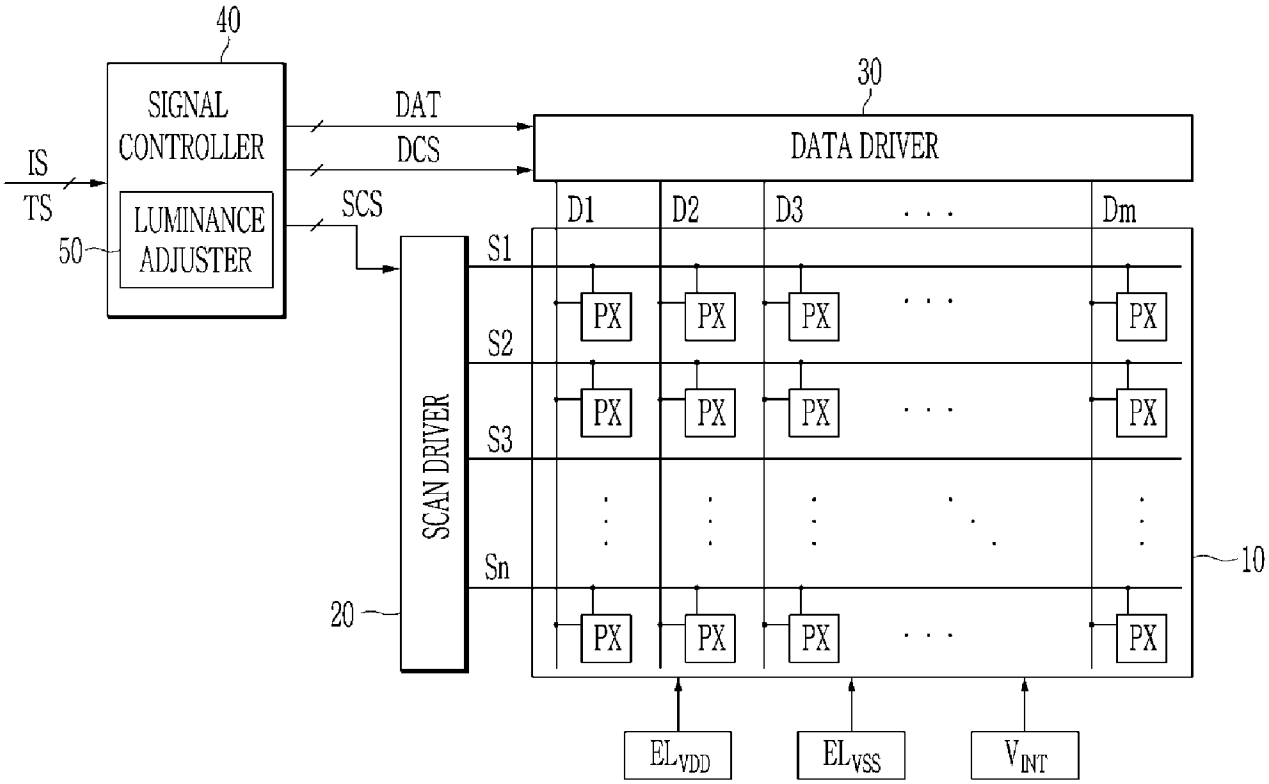
FIG. 1 schematically illustrates a display device according to an embodiment.

FIG. 1 schematically illustrates a display device according to an embodiment.

Referring to FIG. 1, the display device may include a display panel 10, a scan driver 20, a data driver 30, and a signal controller 40.

The display panel 10 may include pixels PX. The display panel 10 may provide a screen on which an image is displayed, and the screen may be implemented by the pixels PX. The display panel 10 may be a light emitting display panel including a light emitting diode ("LED") or an organic light emitting diode ("OLED"), but the kind of the display panel 10 is not limited as long as it is a display panel capable of displaying an image by a combination of the pixels PX. The display panel 10 may include signal lines such as scan lines S1 to Sn and data lines D1 to Dm. The scan lines S1 to Sn may be connected to the scan driver 20 (also referred to as a gate driver), and the data lines D1 to Dm may be connected to the data driver 30. The pixels PX may be connected to the scan lines S1 to Sn and the data lines D1 to Dm, respectively, to receive scan signals and data voltages. Each of the pixels PX may be supplied with a first power voltage $EL_{VDD}$ as a high potential driving power, and may be supplied with a second power voltage $EL_{VSS}$ as a low potential driving power. The pixel PX may be supplied with an initialization voltage $V_{INT}$.

The scan driver 20 may generate a scan signal based on a scan control signal SCS to apply it to the scan lines S1 to Sn.

The data driver 30 may apply a data voltage to the data lines D1 to Dm based on a data control signal DCS and an image data DAT.

The signal controller 40 may receive an input image signal IS, a timing signal TS, and the like to generate the scan control signal SCS, the data control signal DCS, and the image data DAT based on these signals. The timing signal TS may include a horizontal synchronization signal, a vertical synchronization signal, a data enable signal, a clock signal, and the like. The scan control signal SCS may include a scan start signal, a scan clock signal, and the like. The data control signal DCS may include a data sampling pulse, a data sampling clock signal, a data output enable signal, and the like. The signal controller 40 may supply the scan control signal SCS to the scan driver 20, and may supply the data control signal DCS and the image data DAT to the data driver 30.

The signal controller 40 may include a luminance adjuster 50. The luminance adjuster 50 may generate image data DAT for adjusting luminance of the pixels PX of the display panel 10 in consideration of a state and operating conditions of the display panel 10. The luminance adjuster 50 may receive a luminance value for each gray measured by an external measurement device (not illustrated). The measurement device may be used, for example, to inspect image quality such as luminance, chromaticity, and uniformity in a shipment inspection step of the display device.

Figure 2:
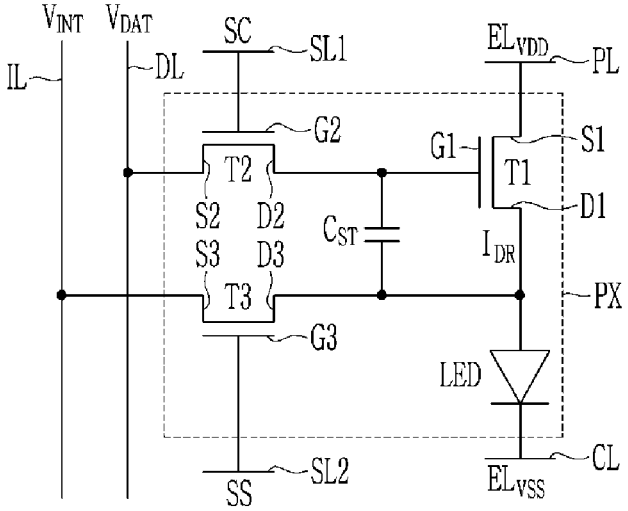
FIG. 2 illustrates a circuit diagram of a pixel of a display device according to an embodiment.

FIG. 2 illustrates a circuit diagram of a pixel PX of a display device according to an embodiment.

The pixel PX includes transistors T1, T2, and T3, a storage capacitor $C_{ST}$, and a light emitting diode LED.

The transistors T1, T2, and T3 may include a first transistor T1, a second transistor T2, and a third transistor T3. The transistors T1, T2, and T3 may include N-type transistors. Unlike FIG. 2, the transistors T1, T2, and T3 may include P-type transistors, or may include N-type transistors and P-type transistors.

The first transistor T1 may include: a gate electrode G1 (also referred to as a control electrode) connected to a first electrode of the storage capacitor $C_{ST}$ and a second electrode D2 (also referred to as a drain electrode or an input electrode) of the second transistor T2; a first electrode S1 (also referred to as a source electrode or an input electrode) connected to a driving voltage line PL; and a second electrode D1 connected to a first electrode of the light emitting diode LED and a second electrode of the storage capacitor $C_{ST}$. The first transistor T1 may receive a data voltage $V_{DAT}$ depending on a switching operation of the second transistor T2 to supply a driving current $I_{DR}$ to the light emitting diode LED depending on a voltage stored in the storage capacitor $C_{ST}$. The first transistor T1 is a transistor that outputs the driving current $I_{DR}$ to the light emitting diode LED, and may be referred to as a driving transistor.

The second transistor T2 may include: a gate electrode G2 connected to a first scan line SL1; a first electrode S2 connected to a data line DL; and a second electrode D2 connected to the first electrode of the storage capacitor $C_{ST}$ and a gate electrode G1 of the first transistor T1. The second transistor T2 may be turned on depending on a first scan signal SC applied through the first scan line SL1 to transfer a reference voltage or a data voltage $V_{DAT}$ to the gate electrode G1 of the first transistor T1 and the first electrode of the storage capacitor $C_{ST}$. The second transistor T2 may also be referred to as a switching transistor.

The third transistor T3 may include: a gate electrode G3 connected to a second scan line SL2; a first electrode S3 connected to an initialization voltage line IL; and a second electrode D3 connected to the second electrode of the storage capacitor $C_{ST}$ and the first electrode of the light emitting diode LED. The third transistor T3 may be turned on depending on a second scan signal SS applied through the second scan line SL2 to transmit the initialization voltage $V_{INT}$ to the first electrode of the light emitting diode LED and a second electrode of the storage capacitor $C_{ST}$ to initialize a voltage of the first electrode of the light emitting diode LED. The third transistor T3 may also be referred to as an initialization transistor. The initialization voltage line IL may be used to sense a threshold voltage of the first transistor T1 or the driving current $I_{DR}$ outputted from the first transistor T1, and may be called a sensing wire.

It may include a first electrode connected to the gate electrode G1 of the first transistor T1 of the storage capacitor $C_{ST}$, and a second electrode connected to the second electrode D3 of the third transistor T3 and the first electrode of the light emitting diode LED.

The light emitting diode LED may include a first electrode connected to the second electrode D1 of the first transistor T1 and a second electrode connected to a common voltage line CL. When the first transistor T1 is turned on, the driving current $I_{DR}$ may flow through the light emitting diode LED, and the light emitting diode LED may emit light with a predetermined luminance.

An operation of the pixel PX illustrated in FIG. 2 during one frame will now be described. The pixel PX may operate over approximately four periods during one frame, i.e., an initialization period, a sensing period, a data input period, and an emission period.

The first scan signal SC of a high level and the second scan signal SS of a high level are supplied during the initialization period to turn on the second transistor T2 and the third transistor T3. A reference voltage from the data line DL may be supplied to the gate electrode G1 of the first transistor T1 and the first electrode of the storage capacitor $C_{ST}$ through the turned-on second transistor T2, and the initialization voltage $V_{INT}$ may be supplied to the second electrode D1 of the first transistor T1 and the first electrode of the light emitting diode LED through the turned-on third transistor T3. Accordingly, the second electrode D1 of the first transistor T1 and the first electrode of the light emitting diode LED may be initialized to the initialization voltage $V_{INT}$ during the initialization period. In this case, a voltage corresponding to a difference between the reference voltage and the initialization voltage $V_{INT}$ may be stored in the storage capacitor $C_{ST}$.

When the second scan signal SS is changed to a low level in a state where the first scan signal SC of a high level is maintained for a sensing period, the second transistor T2 may maintain a turn-on state and the third transistor T3 may be turned off. The gate electrode G1 of the first transistor T1 and the first electrode of the storage capacitor $C_{ST}$ may maintain the reference voltage through the turned-on second transistor T2, and the second electrode D1 of the first transistor T1 and the first electrode of the light emitting diode LED may be disconnected from the initialization voltage $V_{INT}$ through the turned-off third transistor T3. Accordingly, when a current flows from the first electrode S1 to the second electrode D1 and a voltage of the second electrode D1 becomes "a reference voltage—a threshold voltage of the first transistor T1," the first transistor T1 may be turned off. In this case, a voltage difference between the gate electrode G1 of the first transistor T1 and the second electrode D1 is the storage capacitor $C_{ST}$ may be stored, and the threshold voltage of the first transistor T1 may be sensed. A characteristic deviation of the first transistor T1 which may be different for each pixel PX may be externally compensated by generating a data voltage that is compensated by reflecting characteristic information sensed during the sensing period.

When the first scan signal SC of the high level is supplied and the second scan signal SS of a low level is supplied during a data input period, the second transistor T2 may be turned on and the third transistor T3 may be turned off. The data voltage $V_{DAT}$ from the data line DL may be supplied to the gate electrode G1 of the first transistor T1 and the first electrode of the storage capacitor $C_{ST}$ through the turned-on second transistor T2. In this case, the second electrode D1 of the first transistor T1 and the second electrode of the light emitting diode LED may maintain a potential during the sensing period substantially as it is by the first transistor T1 which is turned off.

During the emission period, the first transistor T1 that is turned on by the data voltage $V_{DAT}$ transferred to the gate electrode G1 may generate a driving current $I_{DR}$ according to the data voltage $V_{DAT}$, and the light emitting diode LED may emit light with predetermined luminance by the driving current $I_{DR}$.

Figure 3:
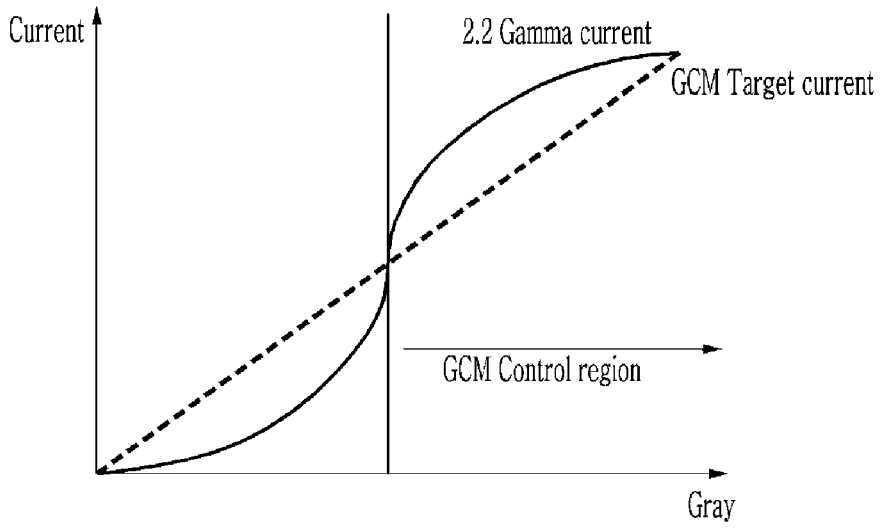
FIG. 3 illustrates a gray-current graph of a display device according to an embodiment.

FIG. 3 illustrates a gray-current graph of a display device according to an embodiment.

After the display device is manufactured, gamma tuning for adjusting the image data DAT to match a predetermined gamma value may be performed. The gamma tuning may be to control the display panel 10 to display luminance for each gray according to a set gamma value (e.g., 2.2). When the display device is an emissive display device, the luminance of each pixel PX is controlled by the driving current $I_{DR}$ that is outputted from the driving transistor T1, and thus the gamma tuning may be to tune the data voltage $V_{DAT}$ that controls the driving current $I_{DR}$. The data voltage $V_{DAT}$ is determined based on the image data DAT, so the gamma tuning may be to adjust the image data DAT.

The gamma tuning may be performed before the luminance adjustment technique is applied. The luminance adjustment technique may include global current management (GCM), net power control ("NPC"), and the like, and may be performed by the luminance adjuster 50.

A global current may be a current supplied to the display panel 10 to drive the pixels PX. The global current may correspond to a sum of driving currents $I_{DR}$ of the pixels PX. When the display panel 10 is driven to display an image, a temperature of the display panel 10 rises, and when the temperature of the display panel 10 rises, even if the data voltage $V_{DAT}$ is the same, the driving current $I_{DR}$ that is outputted from the driving transistor T1 may increase to increase luminance. The GCM, which is a technique for preventing an increase in the driving current $I_{DR}$, is to make the luminance constant by making the driving current $I_{DR}$ constant regardless of the temperature. As an example of the GCM, there is a method that when the temperature of the display panel 10 rises, the increase in the driving current $I_{DR}$ may be prevented by reducing the data voltage $V_{DAT}$ more than a gamma-tuned data voltage.

The NPC is to adjust the luminance of the display panel 10 according to a load ratio of a screen to improve image quality uniformity. Herein, the load ratio may indicate a ratio of a lit region to an entire region (i.e., a region of the pixels PX that emit light by receiving the driving current $I_{DR}$) of the screen provided by the display panel 10. For example, when only 10 percentages (%) of the entire screen is on, the load ratio is 10%.

As the luminance adjustment technique is applied, gamma that is measured during gamma tuning may be different from gamma that is measured after the luminance adjustment technique is applied. During gamma tuning, the data voltage is set in a condition in which the luminance adjustment techniques are not applied, but after the gamma tuning is completed, gamma may be measured under a condition in which the luminance adjustment technique such as the GCM is applied. When the GCM is started, it is controlled with a target current set according to the GCM (hereinafter, referred to as a GCM target current, or simply a target current), and from this point, as the luminance is changed (e.g., decreased), a shift of a gamma curve may occur. The GCM may be controlled by referring to the current value (corresponding to a sum of the driving currents $I_{DR}$) measured during the gamma tuning to prevent the gamma curve from being shifted when measuring gamma after the GCM. For example, it is possible to prevent the gamma value measured after applying the GCM from being calculated differently from an initially set gamma value, by measuring the gamma while controlling the GCM with resetting the GCM target current and referring to the current value measured during gamma tuning (hereinafter, a current value is simply referred to as a current).

A method for preventing gamma shift when measuring gamma after applying the GCM will be described with reference to FIG. 4.

Figure 4:
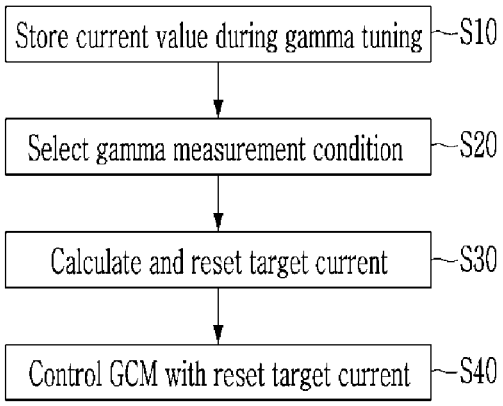
FIG. 4 illustrates a flowchart showing a gamma measurement method according to an embodiment.

FIG. 4 illustrates a flowchart showing a gamma measurement method according to an embodiment.

First, a current value that is measured during gamma tuning may be stored (S10). The display device may include a storage for storing the current value within or outside the signal controller 40. The stored current value may be a current value depending on a load ratio of a measurement region during gamma tuning. Here, the measurement region is a region in which a current value is measured on a screen provided by the display panel 10, and the load ratio is a ratio of the measurement region to a total region of the screen provided by the display panel 10. In the entire screen, the driving current $I_{DR}$ may not be applied to regions other than the measurement region. The current value depending on the load ratio may correspond to a sum of the driving currents $I_{DR}$ of the pixels PX included in the measurement region, and accordingly, when the load ratio of the measurement region increases, the current value may increase in proportion to the increase of the load ratio. The current value may be measured during the gamma tuning. For example, the current value may be obtained by sensing the driving current $I_{DR}$ through the initialization voltage line IL connected to each pixel PX (refer to FIG. 2) and summing the sensed driving currents $I_{DR}$ of the pixels PX. The current value may be stored for each gradation (e.g., 0 to 255 grays). In another embodiment, the current value may be stored for some of the grays (e.g., 0, 64, 128, 192, and 255 grays). Even when the current values for only some grays are stored, current values for other grays may be calculated by using an interpolation method or the like.

Then, a gamma measurement condition may be selected (S20). The gamma measurement condition may be a measurement condition required by a manufacturer, supplier, consumer, etc. of a display device, and may be variously changed. The gamma measurement condition may include conditions such as a position and a size of a pattern measured on the display panel 10, a gray thereof, and the like. For example, the gamma measurement condition may be to measure gamma while increasing the gray from 0 to 255 grays by one gray while the pattern size is fixed. As for the gamma measurement condition, a plurality of measurement conditions may be set and stored in the storage 60, and a user may select one of them.

When the gamma measurement condition is selected, the GCM target current may be calculated and a GCM target current $I_{TG}$ may be reset (S30). The GCM target current may be calculated by referring to a current value according to a load ratio measured and stored during gamma tuning. The GCM target current may be calculated in proportion to a magnitude of the load ratio. Specifically, the GCM target current may be calculated by multiplying a current value during gamma tuning by a magnitude of the load ratio. For example, when the current value stored during gamma tuning is the current value when a 1% load ratio (i.e., when gamma tuning, the load ratio of the measurement region is 1%), and the load ratio of the measurement region is 10% under the gamma measurement condition, the GCM target current may be ten times the stored current value. The load ratio of the measurement region during gamma tuning may be different from the load ratio of the measurement region during gamma measurement, but they may be the same in another embodiment.

When calculating the GCM target current, the GCM target current may be reset in consideration of efficiency for each block of the display panel 10 together with the load ratio of the measurement region. The display panel 10 may be divided into a plurality of blocks, and a current weight may be set depending on the efficiency for each block. For example, by applying the NPC, a block with lower efficiency may apply a higher current than other blocks by assigning a current weight. As such, it is possible to control all blocks of the display panel 10 to reach target luminance by reflecting the efficiency for each block.

When the GCM target current is reset as described above, gamma may be measured by controlling the GCM with the reset target current (S40). When the GCM is applied, the signal controller 40 may compare a current value obtained by sensing the driving current $I_{DR}$ of the pixels PX with the reset target current, and when the sensed current value is different from the target current value (e.g., when it is large), may output the image data DAT capable of providing the data voltage $V_{DAT}$ corresponding to the target current $I_{TG}$. According to an embodiment, GCM control may be applied in changing the image data DAT into the analog data voltage $V_{DAT}$ in the data driver 30. That is, although constant image data DAT is outputted from the signal controller 40, a finally changed analog data voltage $V_{DAT}$ may be changed whenever setting is changed.

Gamma is measured while the GCM target current is reset to the current value that matches the gamma value set during gamma tuning, and even when the GCM is applied, it may be measured as a same gamma value as a gamma value set during gamma tuning before applying the GCM. In other words, as the GCM is controlled with a current that matches the gamma value (e.g., 2.2) that is set during gamma tuning, the gamma value may be maintained in a GCM control region during gamma measurement (See FIG. 3). Accordingly, even when there is no defect in the display device, it is possible to prevent an error that may be measured as gamma is shifted when measuring gamma after applying the GCM. The GCM target current is reset only during gamma measurement to prevent such gamma shift. It is possible to maintain the set gamma value during gamma tuning under various measurement conditions by resetting the target current in consideration of the efficiency for each block and load ratio.

Figure 5:
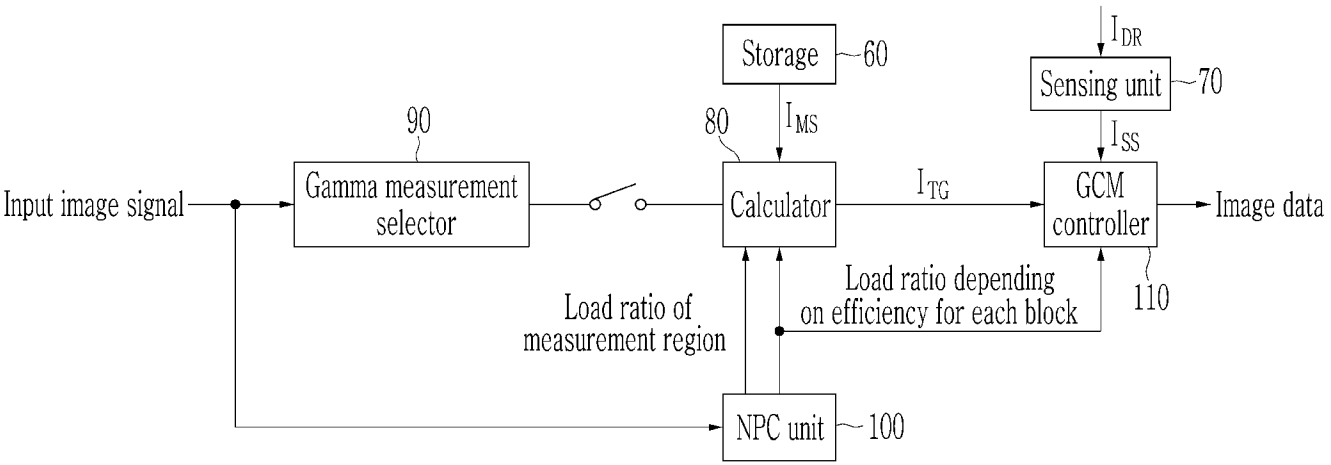
FIG. 5 illustrates a block diagram of a signal controller for resetting a GCM target current according to an embodiment.

FIG. 5 illustrates a block diagram of a signal controller for resetting a GCM target current according to an embodiment.

The signal controller 40 may include a storage 60, a sensing unit 70, a calculator 80, a gamma measurement selector 90, an NPC unit 100, and a GCM controller 110.

The storage 60 may store a current value $I_{MS}$ that is measured during gamma tuning. The stored current value $I_{MS}$ may be referred to when calculating the GCM target current $I_{TG}$ by the calculator 80.

The sensing unit 70 may sense the driving current $I_{DR}$. The sensing unit 70 may sense the driving current $I_{DR}$ through the initialization voltage line IL. The sensed driving current $I_{DR}$ may be supplied to the calculator 80 to calculate the current value $I_{MS}$.

The calculator 80 may calculate the current value $I_{ms}$ by summing the driving currents $I_{DR}$ sensed by the sensing unit 70. Sensing and summing of the driving currents $I_{DR}$ by the sensing unit 70 and the calculator 80 may be performed by, for example, increasing the gray from 0 to 255 grays by one gray, and the calculated current value $I_{MS}$ for each gray may be stored in the storage 60.

The calculator 80 may calculate and reset the GCM target current $I_{TG}$ according to the gamma measurement condition by referring to the current value $I_{MS}$ depending on the load ratio measured during gamma tuning and stored in the storage 60. The calculator 80 may supply the calculated GCM target current $I_{TG}$ to the GCM controller 110.

The calculator 80 may calculate the GCM target current $I_{TG}$ by comparing magnitudes of the load ratios (i.e., a magnitude of the load ratio of the measurement region during gamma tuning and a magnitude of the load ratio of the measurement region when measuring gamma while applying the GCM) of the measurement region provided from the NPC unit 100. When calculating the GCM target current $I_{TG}$, the calculator 80 may consider efficiency of the display panel 10 for each block or a load ratio according to the efficiency for each block, provided from the NPC unit 100. An example in which the calculator 80 calculates the GCM target current $I_{TG}$ in consideration of the load ratio according to the efficiency for each block or the efficiency for each block will be described later.

The gamma measurement selector 90 may select whether to measure gamma and/or may select a gamma measurement condition. For example, the gamma measurement condition may be to measure gamma while increasing the gray from 0 to 255 grays by one gray while the size of the measurement region is fixed. The gamma measurement condition may be preset and stored in the storage 60, or may be inputted from the outside. When gamma measurement is determined by the gamma measurement selector 90 or a gamma measurement condition is selected, the calculator 80 may be activated to reset the GCM target current $I_{TG}$.

The NPC unit 100 may calculate the load ratio of the measurement region from an input image signal, and may provide the calculated load ratio to the calculator 80. The NPC unit 100 may calculate the load ratio for each block and the efficiency for each block of the display panel 10. The NPC unit 100 may calculate a load ratio depending on the efficiency of each block of the display panel 10 based on the load ratio for each block and the efficiency for each block, and may provide the load ratio depending on the efficiency for each block to the calculator 80. The NPC unit 100 may provide the load ratio for each block and/or the efficiency for each block to the calculator 80.

The GCM controller 110 may receive the target current I'm from the calculator 80 to control the GCM. The GCM controller 110 may compare the sensed current value $I_{SS}$ provided from the sensing unit 70 with the reset target current $I_{TG}$ provided from the calculator 80, and may control the GCM such that the sensed current value $I_{SS}$ matches the reset target current $I_{TG}$.

On the other hand, since it is not necessary to reset the GCM target current $I_{TG}$ during normal operation except for gamma measurement, when the gamma measurement selector 90 does not operate, the load ratio depending on the efficiency for each block outputted from the NPC unit 100 may be provided to the GCM controller 110 without going through the calculator 80.

At least one of the storage 60, the sensing unit 70, the calculator 80, the gamma measurement selector 90, the NPC unit 100, and the GCM controller 110 may be included in the luminance adjuster 50.

Figure 6:
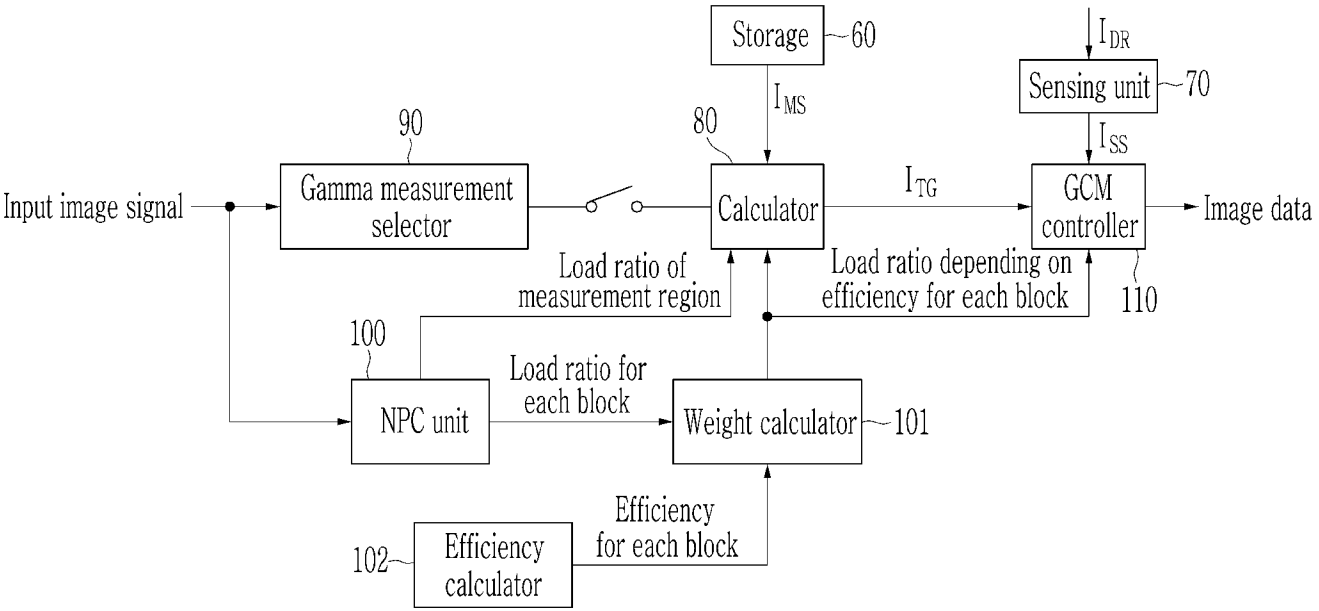
FIG. 6 illustrates a block diagram of a signal controller for resetting a GCM target current according to another embodiment.

FIG. 6 illustrates a block diagram of a signal controller for resetting a GCM target current according to another embodiment.

The embodiment illustrated in FIG. 6 is different from the embodiment illustrated in FIG. 5 in that the signal controller 40 further includes a weight calculator 101 and an efficiency calculator 102.

The NPC unit 100 may calculate the load ratio for each block of the display panel 10, and may provide it to the weight calculator 101. The efficiency calculator 102 may calculate the efficiency for each block of the display panel 10, and may provide it to the weight calculator 101. The weight calculator 101 may calculate a load ratio depending on the efficiency for each block based on the load ratio for each block and the efficiency for each block which are provided, and may provide it to the calculator 80 or the GCM controller 110.

Figure 7:
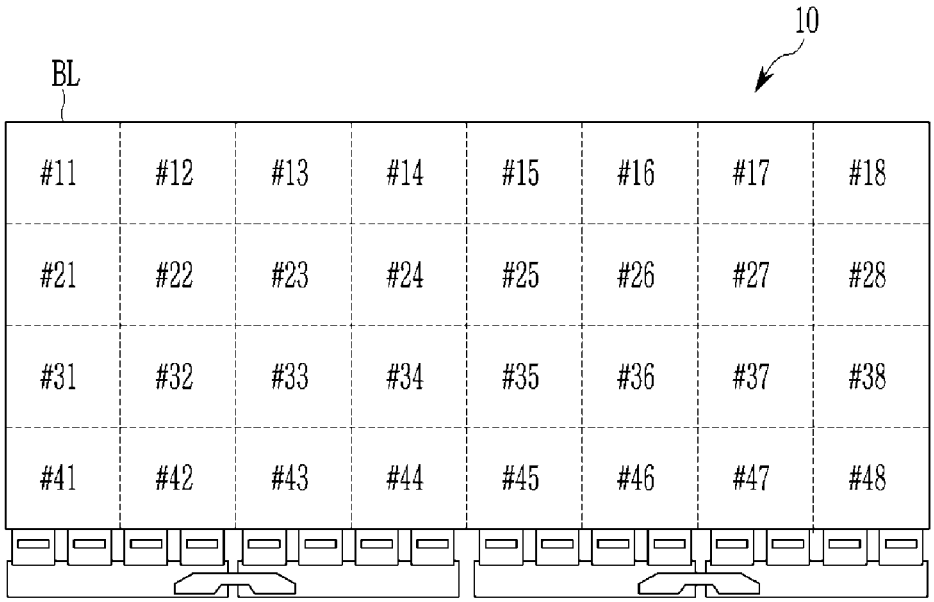
FIG. 7 illustrates an example showing blocks of a display panel according to an embodiment.
Figure 8:
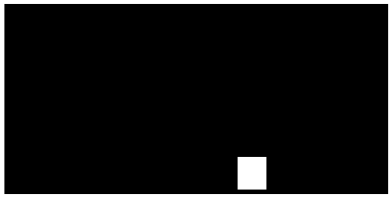
FIG. 8 illustrates an example showing current weighting for each block according to an embodiment.
Figure 8:
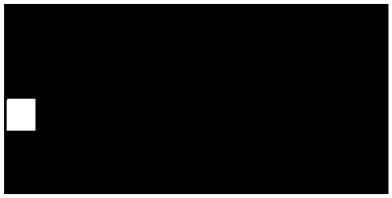

FIG. 7 illustrates an example showing blocks of a display panel according to an embodiment, and FIG. 8 illustrates an example showing current weighting for each block according to an embodiment.

Referring to FIG. 7, the display panel 10 (more precisely, a screen provided by the display panel 10) may be divided into blocks BL. The blocks BL may have a same size, but may have different sizes. Although it is partitioned into 32 blocks BL in FIG. 7, it may be partitioned into fewer or more blocks BL. The display panel 10 may not be uniform as a whole, and image quality deviation may occur depending on regions. For example, the same driving current $I_{DR}$ is supplied to the pixels PX, but some areas of the display panel 10 may be brighter or darker than other regions. When the display panel 10 is managed and controlled by being divided into blocks BL as described above, it is possible to improve the image quality deviation according to the regions of the display panel 10.

Referring to FIG. 8, for example, block #45 is a block with the highest efficiency (hereinafter referred to as a best block) and the efficiency is 10 Candela per Ampere (cd/A), and when a current of 1 Ampere (A) is applied, it may represent luminance of 1000 nit, which is target luminance. For these blocks, the current weight may be set to 1, for example. Block #31 has efficiency of 8 cd/A. Since the efficiency of block #31 is 80% of that of block #46, which is the best block, when a current of 1 A that is equal to that of block #46 is applied to block #31, luminance of 800 nit may be displayed. A current that is higher than a current that is applied to block #45 must be applied in order for block #31 to display the same luminance (1000 nit) as block #45. Accordingly, a current of 1.25 A may be applied by setting the current weight as 1.25. As such, by applying the NPC in consideration of the efficiency of each block, all blocks BL of the display panel 10 may reach the target luminance, and the uniformity of image quality over the entire region of the display panel 10 may be improved.

When resetting the above-described GCM target current, the efficiency of each block of NPC may be referred to as described above. That is, in the display panel 10, the current weight of the best block is set to 1, and for other blocks, the current weight is set to a value (e.g., 1.25, which is the efficiency 10 of block #46 divided by the efficiency 8 of block #31) obtained by dividing the efficiency of the best block by the efficiency of the corresponding block. When measuring gamma, the current weight may be calculated depending on the efficiency of each block of the measurement region, and the current weight of the gamma measurement region may be calculated by summing the current weights for each block having the size of the gamma measurement region. The target current may be reset by multiplying the current weight of the gamma measurement region obtained as described above by the driving current depending on the gamma curve.

Figure 9:
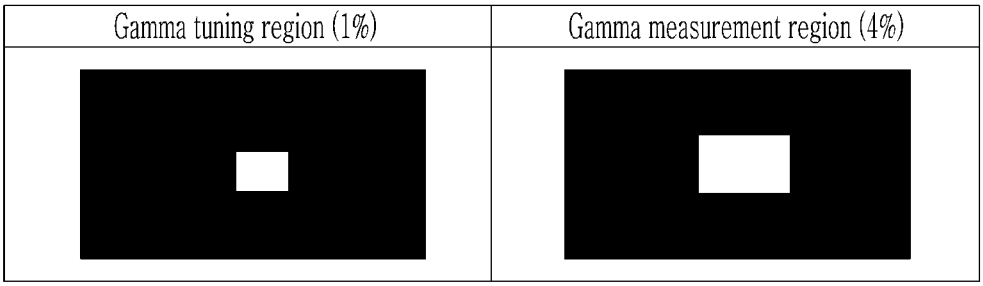
FIG. 9 illustrates an example showing GCM target current resetting depending on efficiency for each block according to an embodiment.

FIG. 9 illustrates an example showing GCM target current resetting depending on efficiency for each block according to an embodiment.

Referring to FIG. 9, it is assumed that the load ratio of the gamma tuning region is 1% and the load ratio of the gamma measurement region is 4%. In gamma tuning, it is assumed that the driving current is tuned to 0 A to 1 A based on the 0 to 255 grays at the 1% load ratio, and the efficiency of the block in which the 1% load ratio is positioned is 10. In this case, the driving current is tuned to a 2.2 gamma current of FIG. 3. It is assumed that the block in which the 4% load ratio of the gamma measurement region is positioned has efficiency of 9. Then, when measuring gamma, the GCM target current may be calculated as a current value (e.g., 0.6 A at 128 grays)×a load ratio size ratio (4 times)×a current weight (1.1) during gamma tuning (2.64 A). Although the table of FIG. 9 shows target currents calculated for some grays, it can be calculated in the same way for other grays.

When the gamma measurement region belongs to a plurality of blocks, the current weight may be calculated by considering a ratio of the gamma measurement region belonging to each block and the efficiency of each block. For example, it is assumed that the gamma tuning region belongs to a block with efficiency of 10, 20% of the gamma measurement region belongs to a block with efficiency 9, and 80% belongs to a block with efficiency of 8. In this case, the current weight for the GCM target current may be calculated as $(0.2\times1.1)+(0.8\times1.25)=1.22$. The GCM target current may be obtained and reset by multiplying the obtained current weight by the load ratio size ratio.

While the inventive concept has been described in connection with what is presently considered to be practical embodiments, it is to be understood that the inventive concept is not limited to the disclosed embodiments, but, on the contrary, is intended to cover various modifications and equivalent arrangements included within the spirit and scope of the appended claims.

What is claimed is:

1. A gamma measurement method of a display device, the method including:

storing a current value that is measured during gamma tuning of a display panel;

updating a target current of global current management (GCM) from an initial value of the target current based on the current value; and measuring gamma of the display panel while applying the updated target current of the GCM.

2. The gamma measurement method of claim 1, wherein the current value is a value of a current according to a load ratio of a first region that is a measurement region during the gamma tuning.

3. The gamma measurement method of claim 2, further comprising selecting a gamma measurement condition of the display panel before the updating of the target current.

4. The gamma measurement method of claim 3, wherein the gamma measurement condition includes a second region that is a measurement region before the updating of the target current, and the updating of the target current includes calculating the target current based on a load ratio relating to the current value and a load ratio of the second region.

5. The gamma measurement method of claim 4, wherein the target current is a value obtained by multiplying the current value by a ratio of a load ratio of the second region to a load ratio of the first region.

6. The gamma measurement method of claim 4, wherein the load ratio of the first region and the load ratio of the second region are different from each other.

7. The gamma measurement method of claim 4, wherein the display panel is divided into a plurality of blocks, and the target current is updated in consideration of efficiency of a block of the plurality of blocks to which the first region belongs and efficiency of a block of the plurality of blocks to which the second region belongs.

8. The gamma measurement method of claim 7, wherein the consideration of the efficiency of the block is to assign current weights such that a block with highest efficiency among the plurality of blocks and another block of the plurality of blocks display same luminance.

9. The gamma measurement method of claim 7, wherein the consideration of the efficiency of the block is to set a weight of the block with the highest efficiency among the plurality of blocks to 1, and to set a weight of another block among the plurality of blocks to a value obtained by dividing the highest efficiency by the efficiency of the another block.

10. The gamma measurement method of claim 9, wherein when the second region belongs to the plurality of blocks, a weight is calculated in consideration of a ratio of the second region belonging to each of the plurality of blocks and an efficiency of each block.

* * * * *